US009188401B2

(12) United States Patent
Pizano

(10) Patent No.: US 9,188,401 B2
(45) Date of Patent: Nov. 17, 2015

(54) COMBINED DIRECT DRIVE GAS PISTON SYSTEM, AND FRONTAL, AMBIDEXTROUS, NON RECIPROCATING, CHARGING SYSTEM FOR AUTOLOADING RIFLE

(71) Applicant: Jorge Pizano, Cordova, TN (US)

(72) Inventor: Jorge Pizano, Cordova, TN (US)

( * ) Notice: Subject to any disclaimer, the term of this patent is extended or adjusted under 35 U.S.C. 154(b) by 0 days.

(21) Appl. No.: 13/855,038

(22) Filed: Apr. 2, 2013

(65) Prior Publication Data

US 2013/0284008 A1 Oct. 31, 2013

Related U.S. Application Data

(60) Provisional application No. 61/686,226, filed on Apr. 2, 2012.

(51) Int. Cl.
*F41A 7/02* (2006.01)
*F41A 5/26* (2006.01)

(52) U.S. Cl.
CPC .... *F41A 5/26* (2013.01); *F41A 7/02* (2013.01)

(58) Field of Classification Search
CPC ..... F41A 7/02
USPC ..... 89/193, 1.4, 169, 179
See application file for complete search history.

(56) References Cited

U.S. PATENT DOCUMENTS

| | | | | |
|---|---|---|---|---|
| 3,198,076 | A | 8/1965 | Stoner | |
| 3,246,567 | A | 4/1966 | Miller | |
| 3,323,418 | A | 6/1967 | Loffer | |
| 3,675,534 | A | 7/1972 | Beretta | |
| 3,686,998 | A | 8/1972 | Seifried | |
| 3,999,461 | A | 12/1976 | Johnson | |
| 4,244,273 | A | 1/1981 | Lagendorfer | |
| 4,475,438 | A | 10/1984 | Sulivan | |
| 4,553,469 | A * | 11/1985 | Atchisson | 89/191.02 |
| 5,214,233 | A | 5/1993 | Weldie | |
| 5,351,598 | A | 10/1994 | Schutz | |
| 5,821,445 | A | 10/1998 | Guhring | |
| 6,634,274 | B1 | 10/2003 | Herring | |

(Continued)

OTHER PUBLICATIONS

"Gas impingement-Vs Gas Piston " Daily caller <http://dailycaller.com/2014/06/25/6-facts-about-ar-15-gas-impingement-vs-piston/>.

(Continued)

*Primary Examiner* — Reginald Tillman, Jr.
(74) *Attorney, Agent, or Firm* — William S. Parks; Hulsey, Hunt & Parks, PC

(57) ABSTRACT

A combined retrofit direct drive gas piston system, for use with M-16 rifle and other appropriated platforms, operating in conjunction with a frontal actuated, ambidextrous, non reciprocating charging system, working in tandem with other existing charging handle systems. The device, conceived to be installed in said rifles in an effortless manner by coupling supporting components with the receiver and the barrel without performing any machining operations. The artifact partially comprises affixing supports, a structural tube to constrain and hold the components, a securing frontal gas block, a regulated direct gas piston system including an independent push bar with alignment rings, springs, and freely displacing part with projections connecting with the exterior handle or hand guard actuator. By enabling to use the extended firer's supporting hand for charging, said artifact solves complicated ergonomic maneuvers required to charge the original M-16. Also eliminates problems of the original gas impingement system.

1 Claim, 13 Drawing Sheets

(56) References Cited

U.S. PATENT DOCUMENTS

| | | | | |
|---|---|---|---|---|
| 7,131,228 | B2 | 11/2006 | Hochstrate | |
| 7,461,581 | B2 | 12/2008 | Leitner-Wise | |
| 7,469,624 | B1 | 12/2008 | Adams | |
| 7,798,045 | B1 * | 9/2010 | Fitzpatrick et al. | 89/1.4 |
| 7,849,777 | B1 | 12/2010 | Zedrosser | |
| 8,156,854 | B2 | 4/2012 | Brown | |
| 8,161,864 | B1 | 4/2012 | Vusknovich | |
| 8,468,929 | B2 | 6/2013 | Larson | |
| 8,561,517 | B2 | 10/2013 | Brown | |
| 8,667,882 | B1 * | 3/2014 | Larson et al. | 89/193 |
| 8,667,883 | B1 * | 3/2014 | Larson et al. | 89/193 |
| 2006/0236582 | A1 | 10/2006 | Lewis | |
| 2014/0060294 | A1 * | 3/2014 | Brown | 89/1.4 |
| 2014/0224103 | A1 * | 8/2014 | Brown | 89/1.4 |

OTHER PUBLICATIONS

"HK 416 Gas Piston Rifle" H&K <https://www.youtube.com/watch?v=2gHIJQoQP3A >.

"STG 44" Wikipedia, The Free Encyclopedia. Wikimedia Foundation, Inc.. Nov. 10, 2005. Web. Jul. 12, 2005.http://en.wikipedia.org/wiki/StG_44.

"Ar 15/ M16 Gas-Piston Conversion System" Osprey Defense <http://www.gaspiston.com/index-2.html >.

"Owners Manual for AR 180B Rifle" ArmaLite Inc.<http://www.armalite.com/images/Manuale%5C180bman.pdf>.

* cited by examiner

FIG. 1 TUBE SUPPORT ADDAPTER PLATE

FLOATING GAS CYLINDER

FLOATING CHARGING HANDLE CYLINDER

FIG. 4 GAS PLUG PISTON REGULATOR

FIG. 6 LOWER GAS BLOCK

FIG. 7 ONE PIECE GAS BLOCK

BOLT CARRIER GAS KEY REPLACEMENT

PUSH ROD AND GUIDE TUBE

COMBINED DIRECT DRIVE GAS PISTON SYSTEM, AND FRONTAL, AMBIDEXTROUS, NON RECIPROCATING, CHARGING SYSTEM FOR AUTOLOADING RIFLE

CROSS REFERENCE TO RELATED APPLICATIONS

This application claims the benefit of Provisional Patent Application Ser. No. 61/686,226 filed on Apr. 2, 2012 by the present inventor.

TERMS AND DEFINITIONS

The term "Charge" refers to the action required to load a new cartridge into the chamber of the firearm barrel and close the breech, leaving the weapon in a condition ready to fire.

The term "Supporting hand" refers to the hand supporting a rifle at the front.

The term "Controlling hand" refers to the hand grabbing a rifle at the rear handle and pulling the trigger.

The term "Breechward" a direction towards the breech of the rifle.

The term "Muzzleward" a direction towards the muzzle of the rifle.

OEM original equipment manufacturer.

The terms rod and push bar are used indistinctively.

Terms such as "under," "over," "in front of," "the back of the gun," or "behind," "anterior," "posterior," "downward," "upward," or "transverse," are used here as somebody firing a gun would understand them, which is by reference to the longitudinal or firing axis of the barrel when the gun is held in the usual horizontal attitude.

The term Floating Cylinder and Floating Cylinder Actuator are used indistinctively.

The term Floating refers to a part not secured in place, unattached, Inclined to move or be moved about.

BACKGROUND OF INVENTION

1. Field of the Invention

This application relates generally to an improvement to the M16 rifle platforms by the addition of a set of mechanisms integrating an extra lateral, ambidextrous, frontal, non reciprocating charging handle, or sliding hand guard, acting in conjunction with a regulated gas piston direct drive system of easy installation, not requiring any machining or permanent modification of the standard M-16 receiver.

2. Background Prior Art

The use of the high pressure gasses inside the barrel of firearms to propel direct drive rods to force the unlocking of the bolt and allows its recoil is very old. AK 47, AK 74, AK (10)1; FAL, Galil, G3 H&K, FN 49, SKS, SVT (40) just to name a few. Recently several manufacturers like Bushmaster, Remington, Smith & Wesson, Rugger, Armalite, Heckler & Koch have incorporated the use of the direct drive gas systems to substitute the gas impingement system of the original M16 rifles and platforms alike, or manufactured retrofits, to substitute the original Gas Impingement System utilized in the popular M16 rifle and related platforms. The automatic cycle of the ejection of used shells, and reload of new rounds into the chamber is made possible by bringing into being an aged combination of pistons, cylinders, push rods, and springs utilizing the high pressure gasses to generate a strong rearwards displacement of the push rod, that in turn impacts a solid spot of the bolt carrier, inside the receiver, unlocking and displacing the bolt rearwards. Numerous nearly identical systems, now in fashion, perform in a similar manner and are being supplied as standard from the factory or as retrofit kits. That is what all of the formerly mentioned manufacturers have done as an attempt to present AN improved version of M16 and AR 15 platform rifles.

However, none of such direct drive gas piston systems takes advantage of mechanical elements already in place to go one significant step forward in solving the notorious disadvantage of the M16 and platforms alike which is associated with the uncomfortable rear charging action that must be performed by pulling straight back a T Charging Handle located at the rear of the receiver, resulting in a very uncomfortable maneuver, against all ergonomic principles, forcing the firer to decompose his firing posture to the extent that it may reveal the location to the enemy.

Replacing the OEM gas impingement system of the M-16 or AR-15 rifles platform by a direct drive gas piston system is not a new idea. Several attempts have been made to do so. It is well known to those who use this rifle, and in the industry that the M-16 is notorious for fouling and jamming due to the original design requiring the discharge gas be directed through a gas impingement tube into the bolt carrier to urge the bolt displacement to the rear in response to the firing of a cartridge and produce the expel of the spent shell and the reloading of a new round into the barrel rear end.

Most of the guns utilizing gases to assist in the opening of the bolt avoid the gas impingement system. AK 47, AK 74, AK (10)1; FAL, Galil, G3 H&K, FN 49, M1, M2 Carbine, M (14), SKS, BAR, FN SCAR, Remington ACR, just to name a few, utilize a combination of rods, and pistons, either being of short stroke or long stroke. However the majority of them have an external, reciprocating charging handle that can potentially harm the firer in its rearwards strong displacement when firing.

Others have developed systems to replace the OEM gas impingement system. Some require that significant portions of the rifle be modified or replaced, such as the barrel and parts within the receiver. These systems have obvious drawbacks. The cost of replacing the barrel and other parts is substantial and unnecessary. If machining is required to install the system, the user must send the rifle to a machinist or gunsmith to be modified, added time and expense to the process, and potentially, introducing error with each independent machining process.

Some manufacturers have designed systems that do not require the replacement of the barrel and are an improvement over the OEM and previous systems, such as the system manufactured by Land Warfare Resources Corporation (LWRC), Bushmaster, Adams, Smith & Wesson, Rugger, Remington Heckler & Koch H&K 416, DPMS, and Armalite. More over, Rock River also recently introduced a rifle having the Frontal Charging System and Direct Drive combination that works only with its proprietary design of an extended Upper receiver and cannot be incorporated to any existing M 16, AR 15 rifle platform. Adcor recently manufactured a rifle providing a combination of frontal charging handle and Direct Drive system, while maintaining the traditional rear charging handle. However, this improvement demands a profound change in the rifle design, and requires for its operation to work in cooperation with the main spring and a frontal extension of the upper receiver. It is not a simple addition to an existing M 16, AR 15 rifle platform that can be added as a retrofit kit, or a simple addition to the production of conventional rifles of that category.

Other important patents to mention are: U.S. Pat. No. 3,246,567, Miller; U.S. Pat. No. 4,244,273, Langerdorfet; U.S. Pat. No. 4,765,224, Morris; U.S. Pat. No. 5,351,598, Schutz, which have in common the utilization of a gas-piston direct drive, and one of them U.S. Pat. No. 6,634,274, Herring; even a structural protecting tube through which the actuating bar moves, and all of them keep the OEM T charging handle of the system, reason for which the problems associated with the rear charging operation by the OEM T handle subsist.

Generically all gas—piston direct drive systems utilize an actuator pneumatic combination of a cylinder, either static or mobile, receiving high pressure combustion gases from a piston, either static or mobile, and wherein the moving part displaces to impact a part of the bolt with sufficient energy to unlock the bolt and allow its opening. Interesting is to notice the very small differences in recently awarded patents with respect to gas-piston mechanisms utilized successfully since the 1940 s like the FN 49 rifle and then by the FAL rifle.

Almost identical is the Adams gas piston system in which the major improvement comes from the ability to extract, for cleaning, in a single piece, the rod and the cylinder, which are a single integral part in their design.

None of these existing systems provide any means to enable, as well, the manual charging action from the front of the rifle. Further more, none of these systems operate inside an easily attached structural tube to contain, guide, and protect the components of the system. None of the above mentioned combinations can be installed in existing M16 or AR15 rifle platforms as a retrofit kit of quick installation or removal without extensive irreversible modification to the receiver.

PRIOR ART DISADVANTAGES

In general, in all previous solutions attempted up to now to replace the gas impingement system, the direct drive gas piston systems use actuator rods, which at a certain instance of the action, where the cylinder uncouples the gas piston portion, it operates in cantilever of long length, being supported only at the rear extreme by a portion penetrating inside the receiver without any other support, situation which generates disturbing harmonic vibrations affecting the performance of the system, overstressing the rod bar, and demanding thicker sections of the part.

The M16-M4 family of rifles is excellent in many respects, and both have undergone upgrades, however, there are still several detrimental flaws inherent to its original design. The most significant flaws are listed below.

In first place:

Flaws related to the OEM gas impingement system

The gas impingement system is a source of gas residues and dirt accumulation causing malfunctioning. The disadvantages of the OEM gas impingement system are well known, primarily due to the hot, dirty gasses being directed into the bolt carrier and receiver. The heat alone tends to wear parts down, exposing this area to thermal cycling. With the addition of soot or carbon from the expelled gasses, the moving parts within the bolt carrier and receiver are exposed to a hostile environment. This is exacerbated by the constant need to lubricate this entire area; the oil serving to trap particles and carbon. This combination of factors cause the parts to break, wear, or operate improperly. The areas of failure can include the fouling and wear of the gas rings, loosening of the ejector and extractor springs causing the spent shell to not be ejected properly, the bolt carrier is prevented form traveling properly within the receiver, as the chamber becomes fouled and increases in temperature causing the entrapment of the spent shell, the melting of the gas tube causing a restriction of flow to the bolt carrier and subsequent failure. Basically, to ensure the proper operation of the rifle, it must be cleaned and continually lubricated. With many parts to keep track of, consistent cleaning is more difficult in the field.

In second place:

Flaws related to the position of the T Charging handle in M 16 rifles, Conflicting with ergonomy and shooter's comfort, and the restriction to use large scopes.

The M-16 or AR-15 has a charging T handle located at the rear of the receiver that is notorious for the difficulty to the firer to perform the charging action in a comfortable manner, conflicting with human ergonomy, and keeping the required body movements within few number of operations in short displacements.

The charging maneuver is required when there is a malfunction in the fire cycling: a misfiring; a bad cartridge ejection; a jamming, and a new magazine to load; a bad cartridge, situations which are common when shooting.

When firing from the standing position, the Charging action of a M16 demands the following body maneuvers: the supporting hand stops holding the gun from and leaves the front of the rifle in cantilever, leaving the controlling hand responsible of keeping the gun horizontal and creating a large moment about the wrist of the controlling hand; then the supporting hand approaches and grabs an original T charging handle placed about 3 inches above relative to the of the wrist of the controlling hand, in a movement that involves the full lateral articulation of the wrist to the side; then pulls linearly horizontally for about 5 inches with rearwards with a force of about 5 pounds in a region where the arm has nearly completed its articulation about the elbow, and has to be further assisted by a rotation of the torso; then release the T handle; and return to the front to assist in supporting the rifle at the front.

In the kneeling position the same body posture decomposition is required, however, due to body balancing reasons it often requires to abandon the position causing more discomfort, and possibly compromising the concealed firer position.

In the prone position it is very difficult to charge fast because the elbow of the supporting hand has to leave the ground to bring the supporting hand back to be close to the top of the wrist of the controlling hand to pull back the T handle, resulting in a very uncomfortable posture. Some shooters totally decompose the posture by projecting the controlling hand holding the rifle muzzlewards to approach the supporting hand to combinedly perform the charging maneuver.

These ergonomic inconveniences have very negative tactical repercussions directly reflecting in much longer time required to have a good sight picture to be back on target, and which is worse compromising the position of the firer As a consequence of the above there are:

Flaws related to the restriction to use of certain optical devices.

The original position of the T charging handle in the M 16 at the rear of the receiver conflicts in Vertical space with the use of powerful telescopic sights, which are normally large in diameter at the ocular lens at the rear. That conflict of interfering space has required developing a special type of short telescopic sights for M16, suitable to partially resolve the space conflict, but depriving the shooter of the benefits of a large scope reflecting in low optical power, and narrow angle of vision.

Costly Tactical and combat performance difficulties derived from the above mentioned limitations are reflected in:

Loss of valuable time to get back on target, due optically to eye readjusting and target acquiring.

Deprivation of the use of large powerful scopes.

Visual loss of the target, loosing track of target happenings and scenario.

Loss of time due to body position readjusting.

Jeopardizing the concealment of the shooter's position.

Loss of accuracy due to recent strong fine muscular activity.

Loss of time due to body repositioning.

Buildup of emotional stress.

Frustration buildup due to loss of potential firing opportunities.

Dangerous potential of compromising the shooter location.

Potential of scope misadjusting due to conflicting area with T handle.

Jamming due to known OEM gas impingement system.

Need of frequent cleaning to remove dirt related to the use of OEM gas impingement system.

What is needed.

What is needed then, and not heretofore provided by the existing art, is a combined solution to both of the mentioned flaws organized, integrated in one single array of mechanisms: Which is a retrofit combination of frontal charging handle, being ambidextrous and not reciprocating, working in association with a system to replace the OEM gas impingement system of the rifle. What is further needed is a retrofit system that can be easily installed in any existing M 16, AR 15 rifle platform, not requiring any machined modifications to the receiver, or replacement of the barrel and other primary parts of the rifle. What is further needed is a retrofit system that is easily assembled and disassembled in the field, by minimizing complexity and the overall number of parts. What is again needed is a retrofit system that can be removed for inspection and cleaning without substantial disassembly of neighboring parts, such as the gas block or hand guard. Even more, what is needed is a charging handle to pull back located in the frontal area being ambidextrous, non reciprocating. What is needed is a array that enables the charging operation to take place alternatively with the supporting hand normally positioned at the front to reduce the time consuming and very uncomfortable charging operation of the M 16 family of rifles by pulling the T handle at the rear. What is needed is a frontal lateral charging handle or a horizontally sliding hand guard or handle connected to a floating charging handle enabling the charge operation to be performed by the so called "pump action", without leaving the supporting hand of the firer away from the front of the rifle without suspending its supporting function. Moreover, what is needed is a charging mechanism capable of operating in tandem with the original T charging handle. Furthermore, what is needed is system complying with all of the above mentioned solutions, and still be capable of operating in tandem with the original rear charging handle without requiring its removal or interfering with its independent action. The use of a structuring tube to provide internal contact of moving parts to provide alignment, and avoid vibration.

Advantages of the Present Invention Application

This invention is different and better than all other prior art because:

It incorporates the use of frontal charging handle operating inside a structural solidly supported guide tube that eliminates the cantilever operation condition of most of the push bars and the associated damaging harmonic vibrations.

This application combines in one device the solution to two flaws of the M16 rile platforms: problems associated with the gas impingement system, and problems associated with the uncomfortable charging pulling action of the T handle at the rear It improves the functioning reliability of the rifle, as well as the tactical performance by reducing the recharging time; preventing the unnecessary potentially compromising body movements; and allowing the use of more powerful scopes.

It is installable without requiring any machining or permanent modification on M16 and AR15 existing rifles widely used over the world without the significant addition of weight and preserving the original characteristic outlook.

It can be uninstalled returning the rifle to the original condition.

Due to the notorious advantages, it is likely to be adopted as OEM for new production rifles.

The OEM rear T handle remains completely independently operative with the frontal charging device, working in tandem.

A selective rotary regulator knob located at the front of the gas block provides a range of gas selection.

The system does not interfere with the semi automatic or full automatic modes.

The world wide used M 16 rifles and platforms alike, are easily retrofit able with one piece solution.

The system eliminates problems associated with the OEM gas impingement, which keeps the bolt and receiver cleaner and colder, the chamber and the breech, demanding less cleaning and providing a more reliable operation.

A Pump Action charging action can be achieved by using a frontal horizontally sliding Hand Guard in combination with the ambidextrous, non reciprocating lateral charging handle.

This invention drastically reduces time to reload and charge.

Drastically reduces the body movements required by the presently used to charge using the rear T handle.

Has important tactical advantages derived from its use.

The system favors the installation of more powerful scopes,

This compact system is better than all previously used direct drive gas systems because it uses supporting tube to reduce damaging harmonic vibrations of the push rod.

The system provides an alternative embodiment having a gas block composed of two sliding disassemble bodies to facilitate the quick complete field disassembly for maintenance.

An adapter part or a plurality of them provide solid constrained rear support to a structural guide tube needed for the installation of this array of mechanisms without requiring any permanent modification or machining of the original receiver.

This invention provides a solution to two flaws by integrating an ambidextrous, non reciprocating frontal charging system, combined with a direct drive gas piston to substitute the original gas impingement system. No permanent modification of the M-16 rifle or AR 15 platform rifles is needed to install this kit. No holes are drilled. No bushings need to be inserted. The original Cocking handle remains operative, or may be removed if wanted. The installation of the kit is reversible and can be executed within minutes.

This invention integrates the following features: an ambidextrous, non reciprocating frontal side charging system solution, combined with a direct drive gas piston to substitute the original gas impingement system. This invention can be factory installed in new rifles, or very simply mounted in existing rifles, as a retrofit kit, to operate in conjunction with the original rear charging handle, if desired, or completely eliminate the rear pulling charging device. It does not interfere with any other operation of that remarkable family of guns.

Its installation does not require hole drilling or permanent modifications to the rifle, and if desired, it can be uninstalled, and the rifle can be brought back to the original Gas Impingement system.

Additionally, the placement of the Charging Handle (30) at the front is very advantageous ergonomically and tactically because it lends to be pulled back with the supporting hand and arm extended in a region where the action of pulling is more comfortable end effortless under an ergonomic perspective, than pulling at the rear of the rifle in a region where the arm has nearly completed its articulation and has to be assisted by a rotation of the torso.

Since no gases go inside the receiver, or into the Bolt Carrier, both remain cleaner, and colder than the original M16 rifle platforms utilizing OEM gas impingement.

In addition, a gas Regulator can be incorporated to the system by the use of a Gas Plug Piston Regulator (40), a cylindrical gas conductor having a radial array with a plurality of holes of diverse diameter (40D) to variably restrict at will the gas flow when aligning with the high pressure gas aperture (65B).

It is easy to strip in the field. Gas Plug Piston Regulator (40) can be easily pulled out for cleaning, and the Floating Gas Cylinder (20) can be cleaned from the front without any further disassembly. If complete stripping is required it is possible to perform very easily when utilizing the two piece gas block consisting in the Lower Gas Block (60), coupled by sliding with the Upper Gas Block (50) towards the muzzle which allows the complete stripping of all of the parts except the Lower Gas Block (60).

Alternatively, a two piece tube, longitudinally cut, can be integrated to the interior of the hand guards in a manner that, when removed, exposes all the elements contained inside the tube for a thorough cleaning. In particular it is important to mention the differences and advantages with respect to Adams U.S. Pat. No. 7,469,624 (20)09. This invention is better because it incorporates a Frontal, Lateral, Ambidextrous Non Reciprocating Charging Handle array that operates in conjunction, but independently from the gas direct drive system.

In order to accomplish the non reciprocating feature of the Charging Handle, the Push Rod (80), the Floating Gas Cylinder (20), and the Floating Charging Handle Cylinder (30) must be separated independent parts of a set. In order to provide alignment, support, rigidity, and positioning to the system the elements operate inside a Guide Tube (70) that is positioned and affixed to the rifle by means of a, Tube Support Adapting Plate (10), at the rear, and affixed to the undercut for Tube Support (50)B at the front. This invention well surpasses and improves on Adams U.S. Pat. No. 7,469,624.

A major advantage and innovation of this invention is the fact that the conception of the Gas Block element offers in one embodiment either the One Piece Gas Block (65), or alternatively, in a different embodiment formed by two parts, being, The Lower Gas Block (60), and the Upper Gas Block (50). The latter offering the possibility of assembling or disassembling the unit by sliding the Upper Gas Block (50) from the front, without removing the Lower gas Block (60) from the Barrel (14) and thus assuring the proper alignment of the parts when it is put back together. This is a completely novel approach in the design and conception of Gas Blocks that facilitate the total disassembly of the unit from the front, for cleaning or installation purposes. The design of the above mentioned pieces is such that they press together one against each other due to a dual dove tail angular joint design when slid and pressed and locked frown the front.

When assembled, the final aspect of the Two Piece Gas Block (50) and, (60) is identical to the One Piece Gas Block (65) with respect to bores, cuts, dimensions, and functionality.

No permanent modification of the M-16 rifle o AR 15 platform rifles is needed to install this kit. The original M 16 Charging handle located at the rear of the upper receiver, may remain in place and active.

SUMMARY

In accordance with one embodiment, this invention generally relates to solutions and improvement to the original design and operation of the M16 family of rifles which still has two detrimental flaws inherent to its original deign.

In first place, the M-16 or AR-15 has a charging handle located at the rear of the receiver that is known for the difficulty to the firer to perform the charging action in a comfortable manner. In second place, the gas impingement system is a source of dirt buildup and malfunctioning. This application combines in one artifact the solution to the above mentioned flaws which in turn promotes other series of tactical benefits deriver from its use. It opens the potential to retrofit existing military rifles with a better charging mechanism that make unnecessary, for a time, the adoption of newer rifle design. A sliding Pump Action front Hand Guard operating in tandem with the existing rear T charging handle is a possible alternative solution.

FIGURES AND DRAWINGS INCLUDED
FIGURES AND DRAWINGS LIST

Most of the drawings are self explanatory; however for a better understanding of the advantages, capabilities and innovation of this invention, some of the drawings are explained in more detail. All drawings are shown in one of the preferred embodiments.

BRIEF DESCRIPTION OF THE DRAWINGS

FIG. 13 is a isometric schematic view of the installation of the Plate Tube Support Adapting Plate (10), which couples sliding from the front with the OEM Barrel Nut, part required for the installation of the system, object of this patent application in M16 rifles without requiring any permanent modification to the OEM receiver or other original parts. The Plate Tube Support Adapting Plate also provides support to

NAME OF THE COMPONENTS AND REFERENCE NUMERALS

Figure 1:
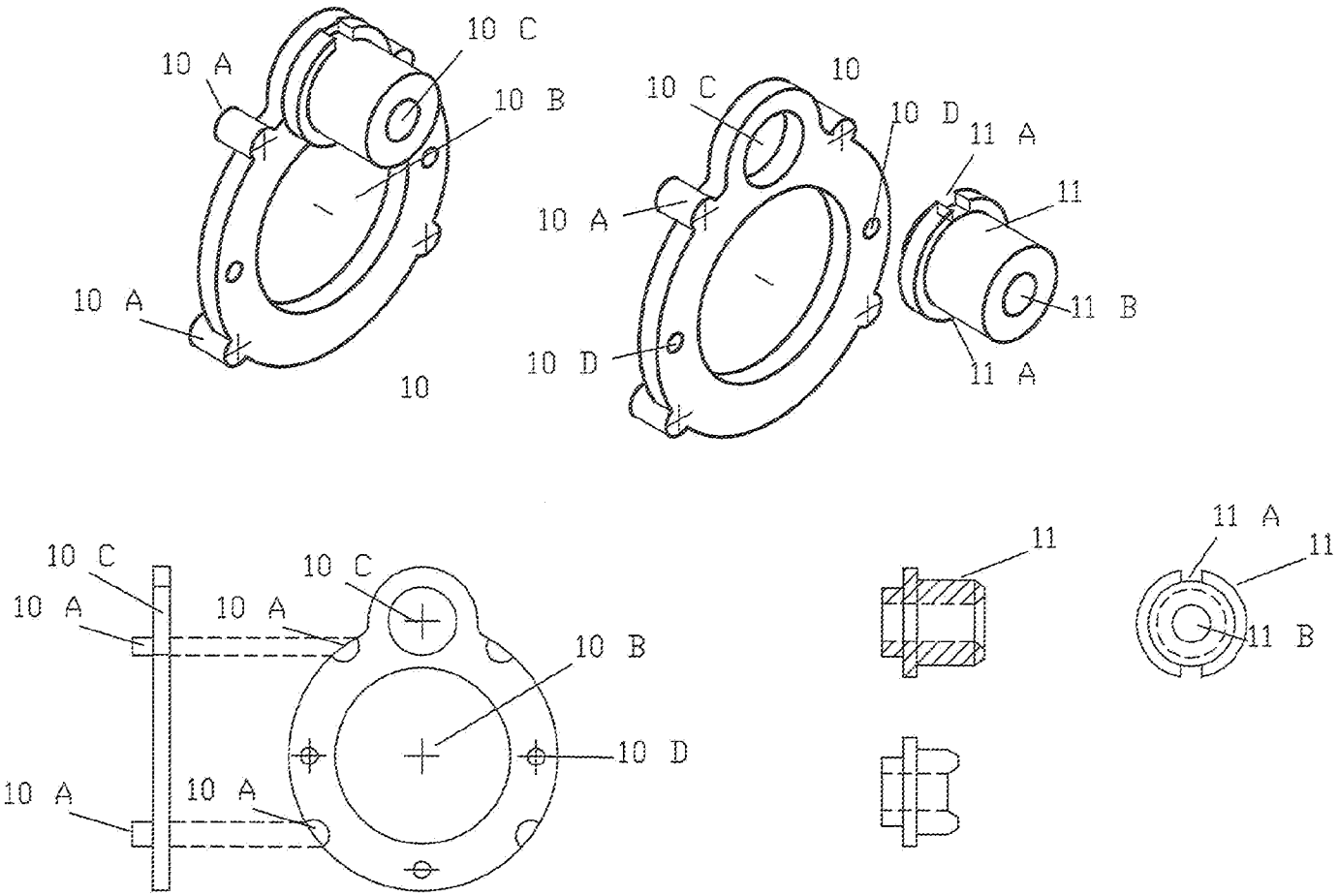
FIG. 1 is an illustration of a Plate Tube Support Adapting Plate (10) of the present invention in orthographic view and exploded perspective.
Figure 2:
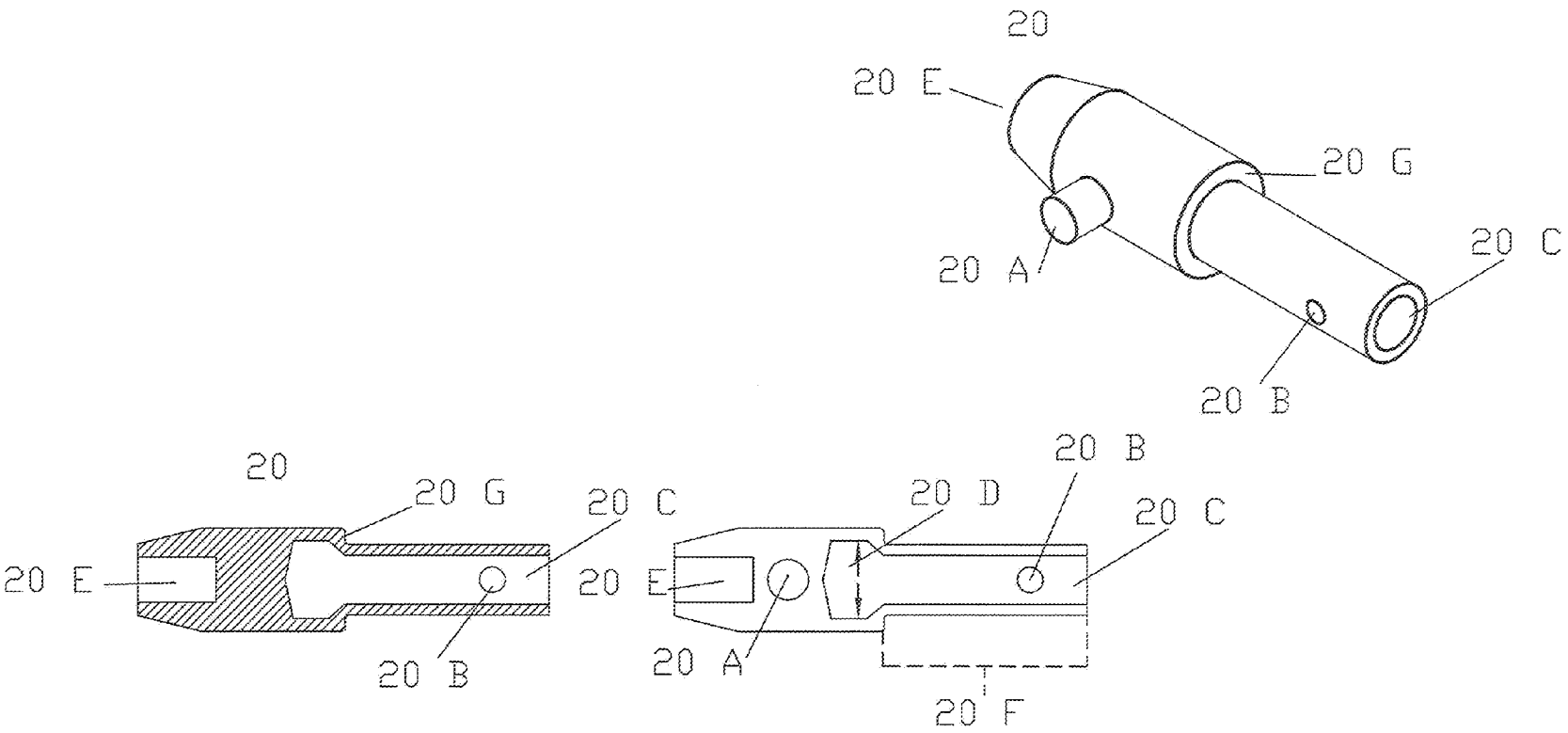
FIG. 2 is an illustration of a Floating Gas Cylinder (20) of the present invention in orthographic view and exploded perspective.
Figure 3:
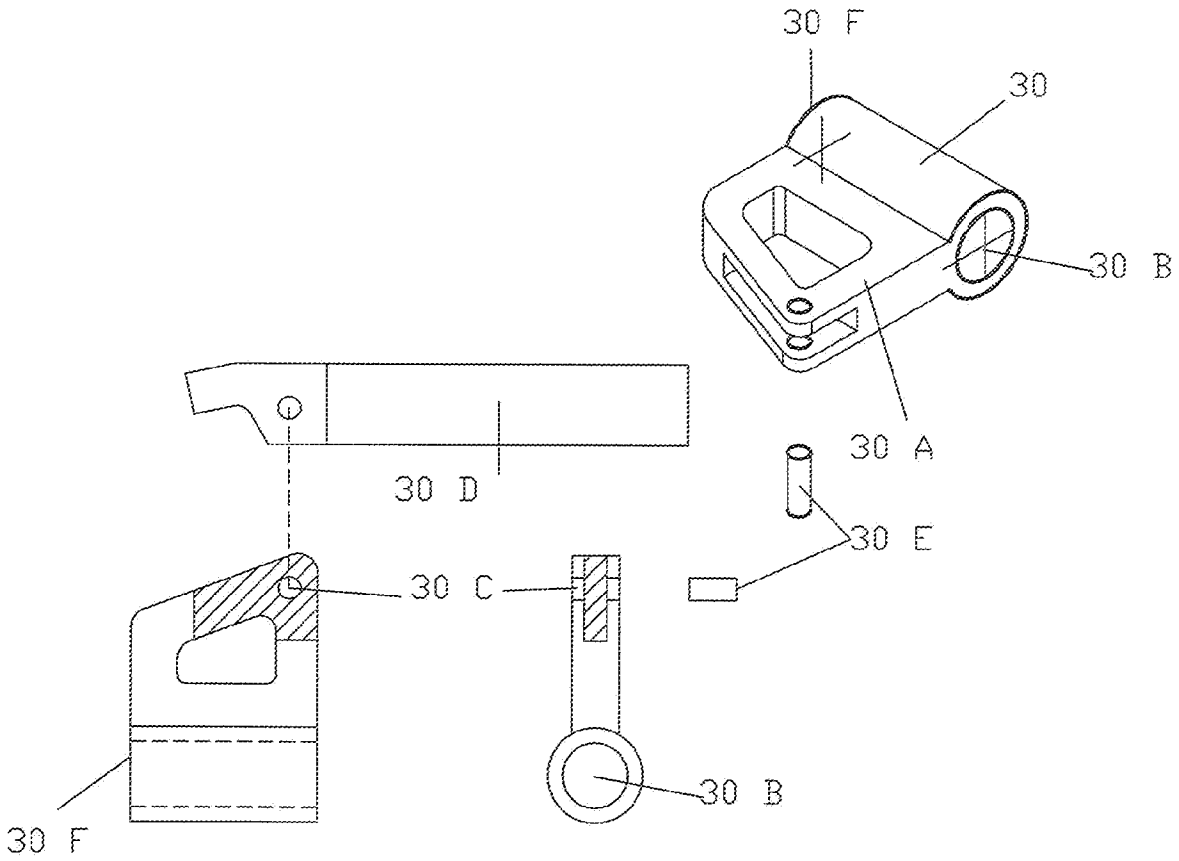
FIG. 3 is an illustration of a Floating Charging Handle Cylinder (30) of the present invention in orthographic view and exploded perspective.
Figure 4:
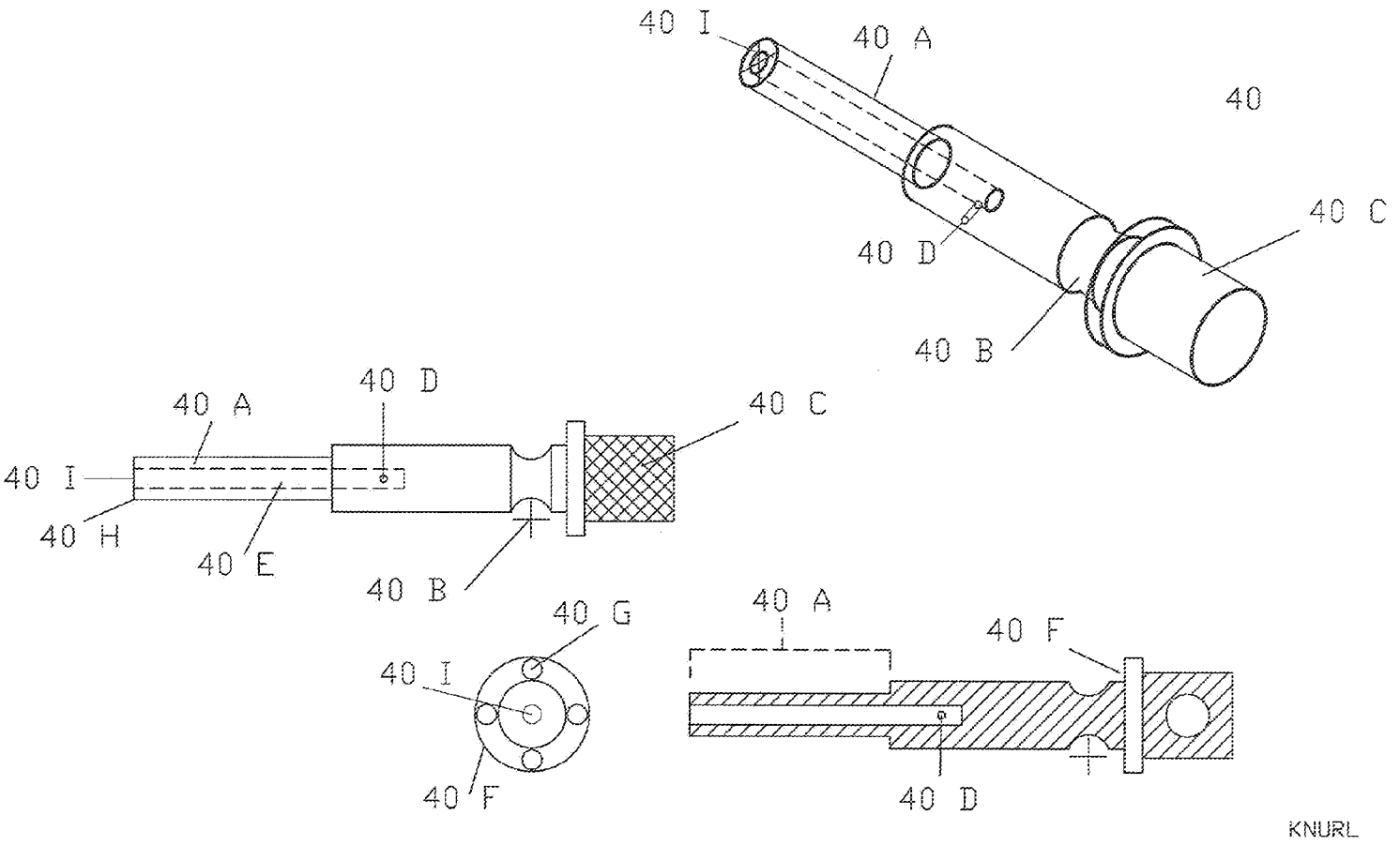
FIG. 4 is an illustration of a Gas Plug Piston Regulator (40) of the present invention in orthographic view and exploded perspective.
Figure 5:
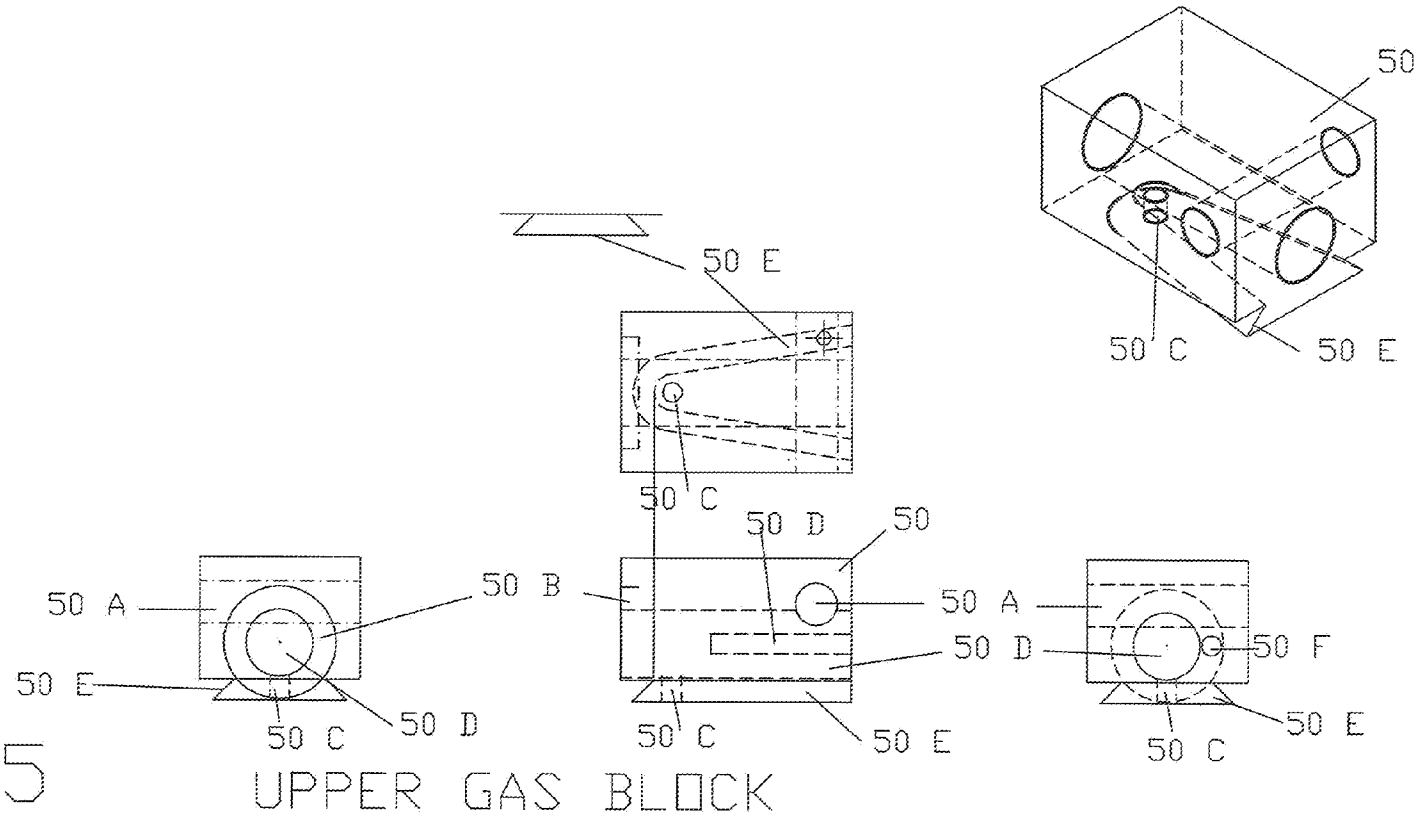
FIG. 5 is an illustration of an Upper Gas Block (50) of the present invention in orthographic view and exploded perspective.
Figure 6:
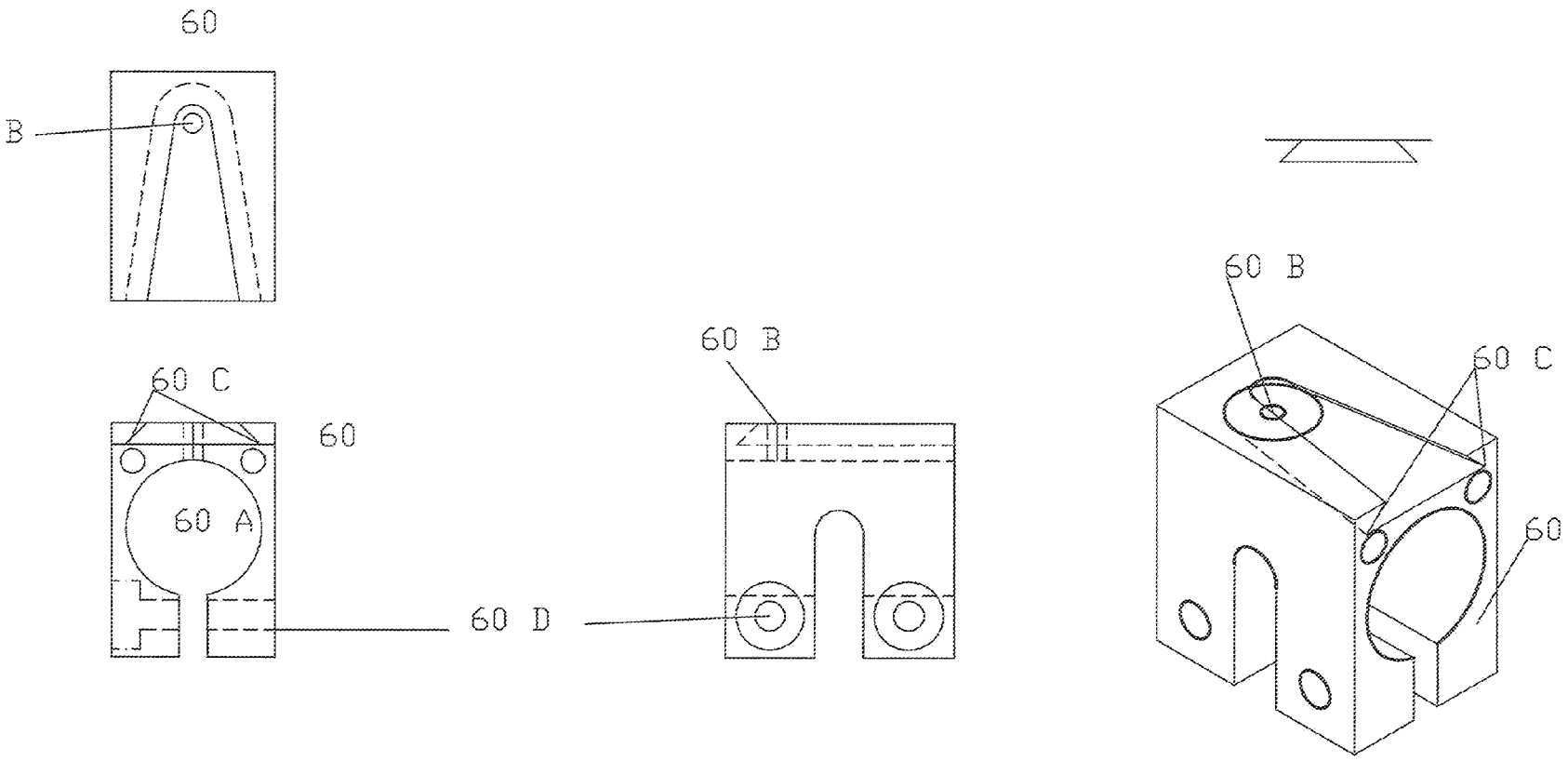
FIG. 6 is an illustration of a Lower Gas Block Lower Gas Block (60) of the present invention in orthographic view and exploded perspective.
Figure 7:
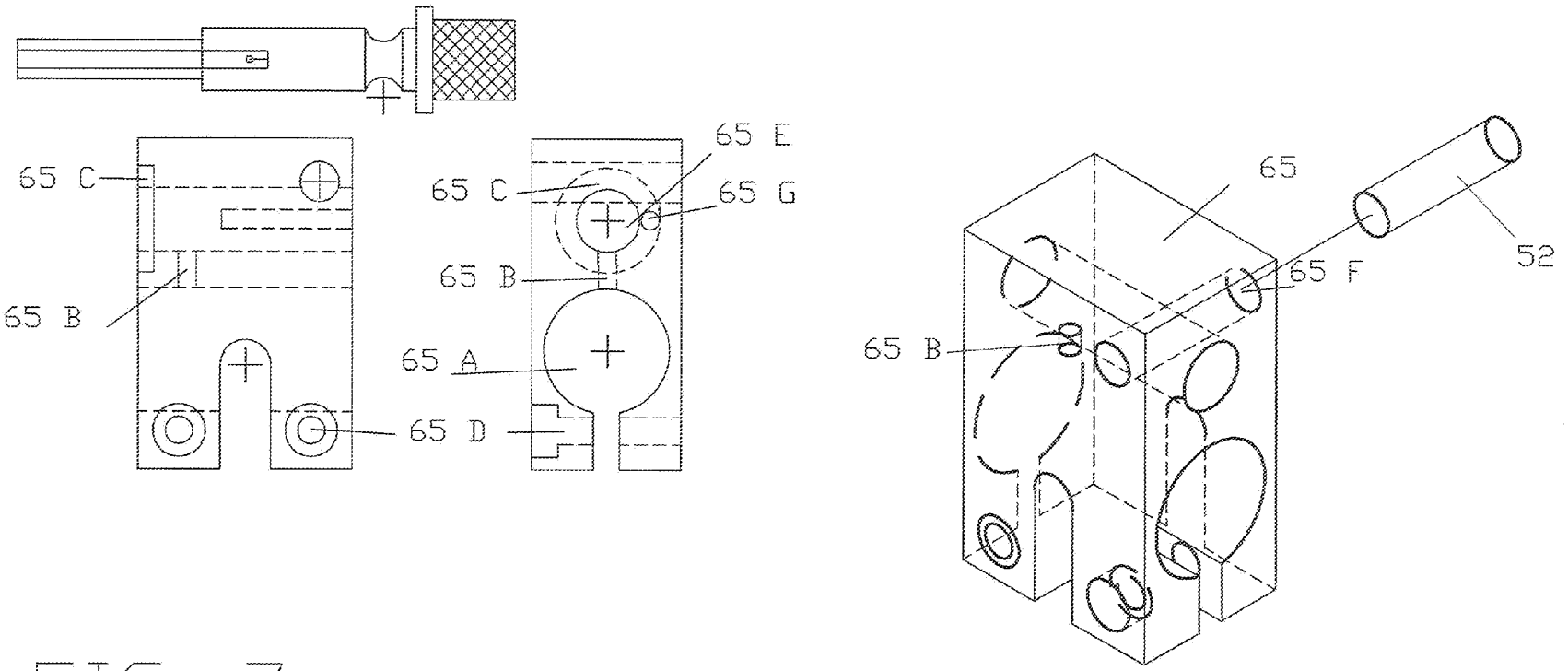
FIG. 7 is an illustration of a One Piece Gas Block (65) of the present invention in orthographic view and exploded perspective.
Figure 8:
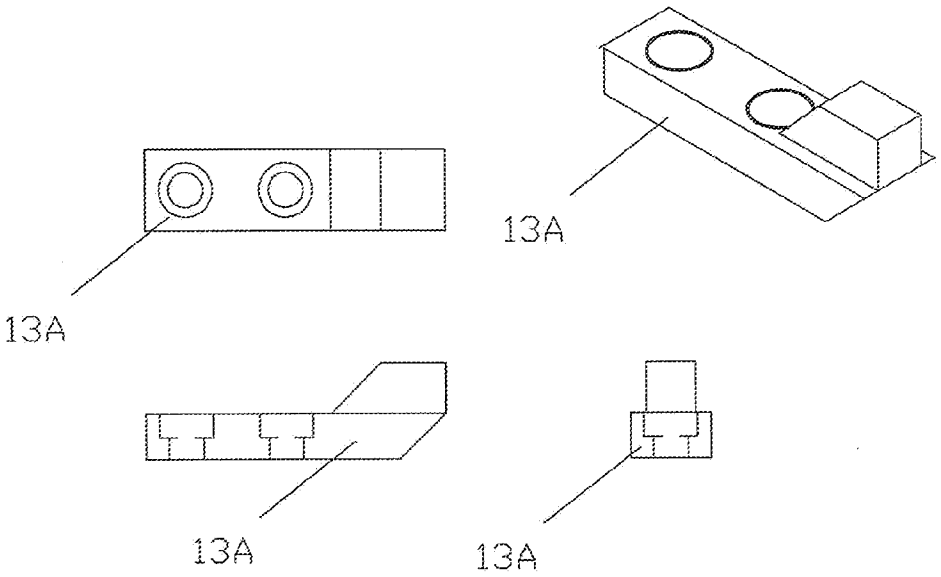
FIG. 8 is an orthographic view of a bolt carrier key replacement (13).
Figure 9:
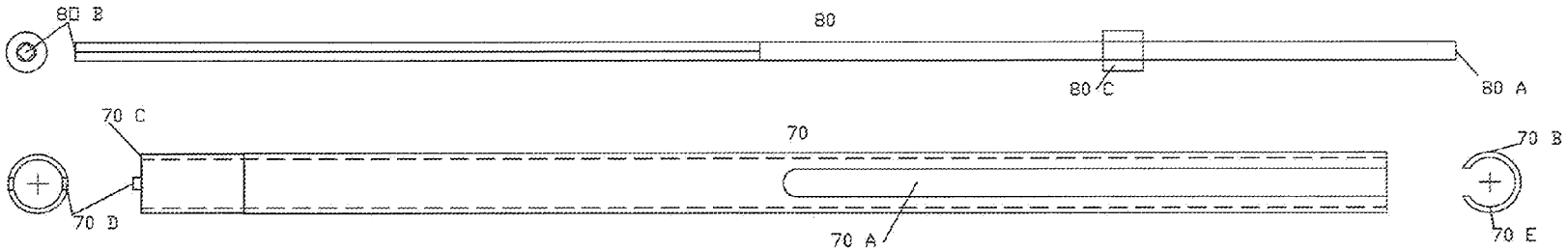
FIG. 9 is an orthographic view of a Push Rod (80) and a Guide Tube (70).
Figure 10:
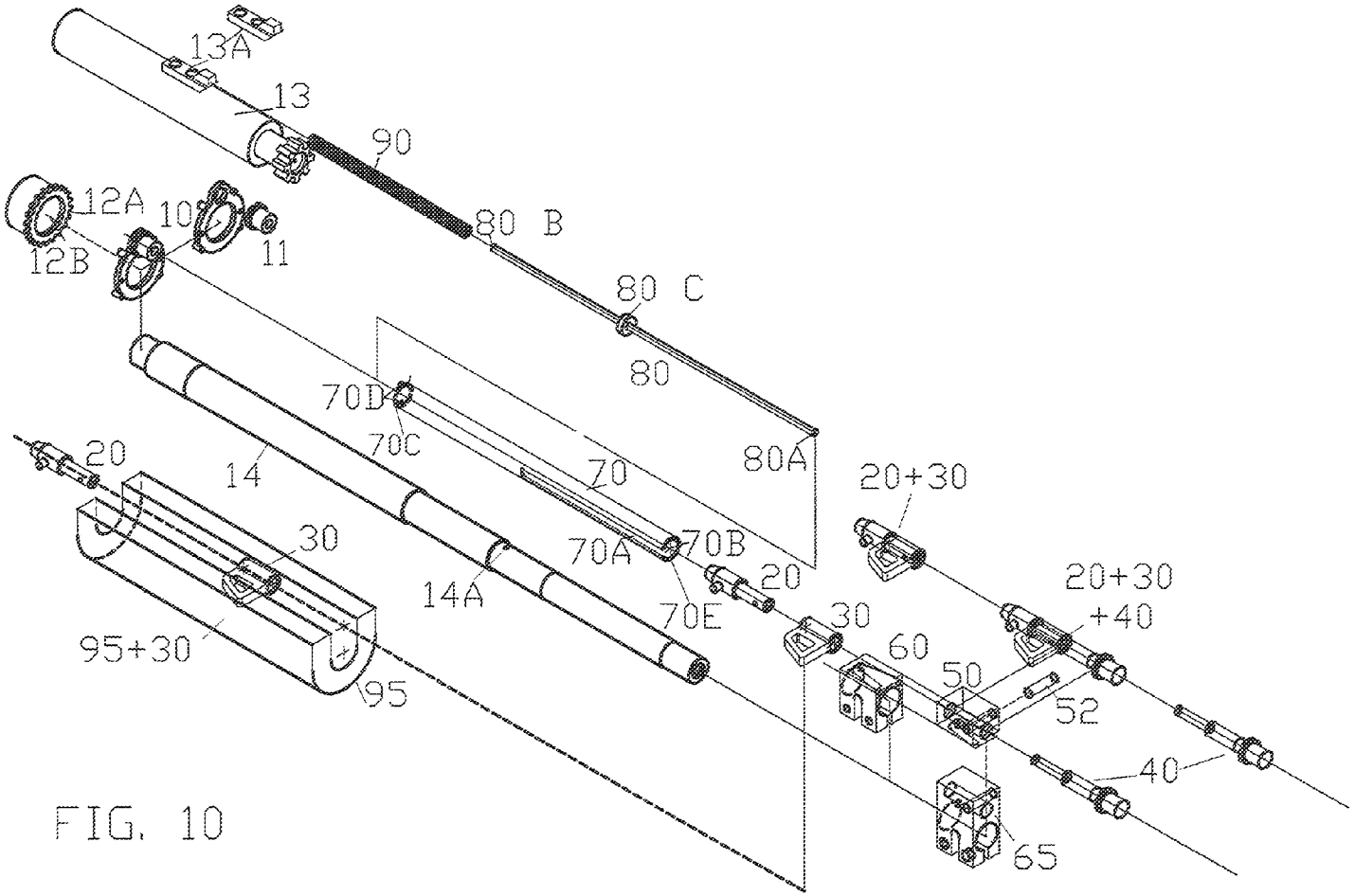
FIG. 10 is an illustration of the complete direct drive retrofit system of the present invention in exploded perspective.
Figure 11:
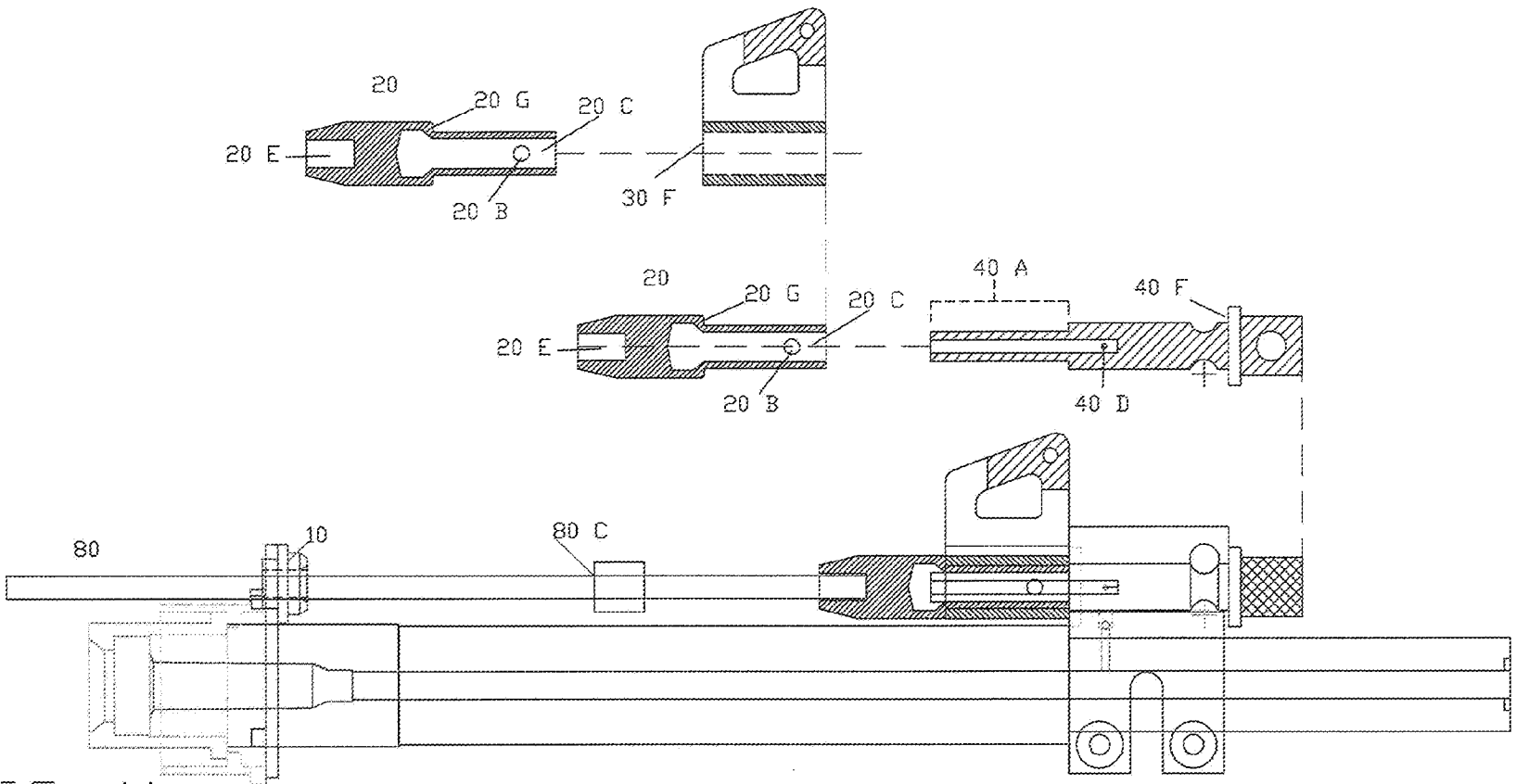
FIG. 11 is a schematic cut view of the complete system installed on an M 16 rifle utilizing the Plate Tube Support Adapting Plate (10), which couples sliding from the front with the OEM Barrel Nut, constraining the Plate Tube Support Adapting plate from rotation and lateral movement. The coupling with the structural support guide tube, which is locked at the front by the gas block, completes the total constringent of the Plate Tube Support Adapting plate.
Figure 12:
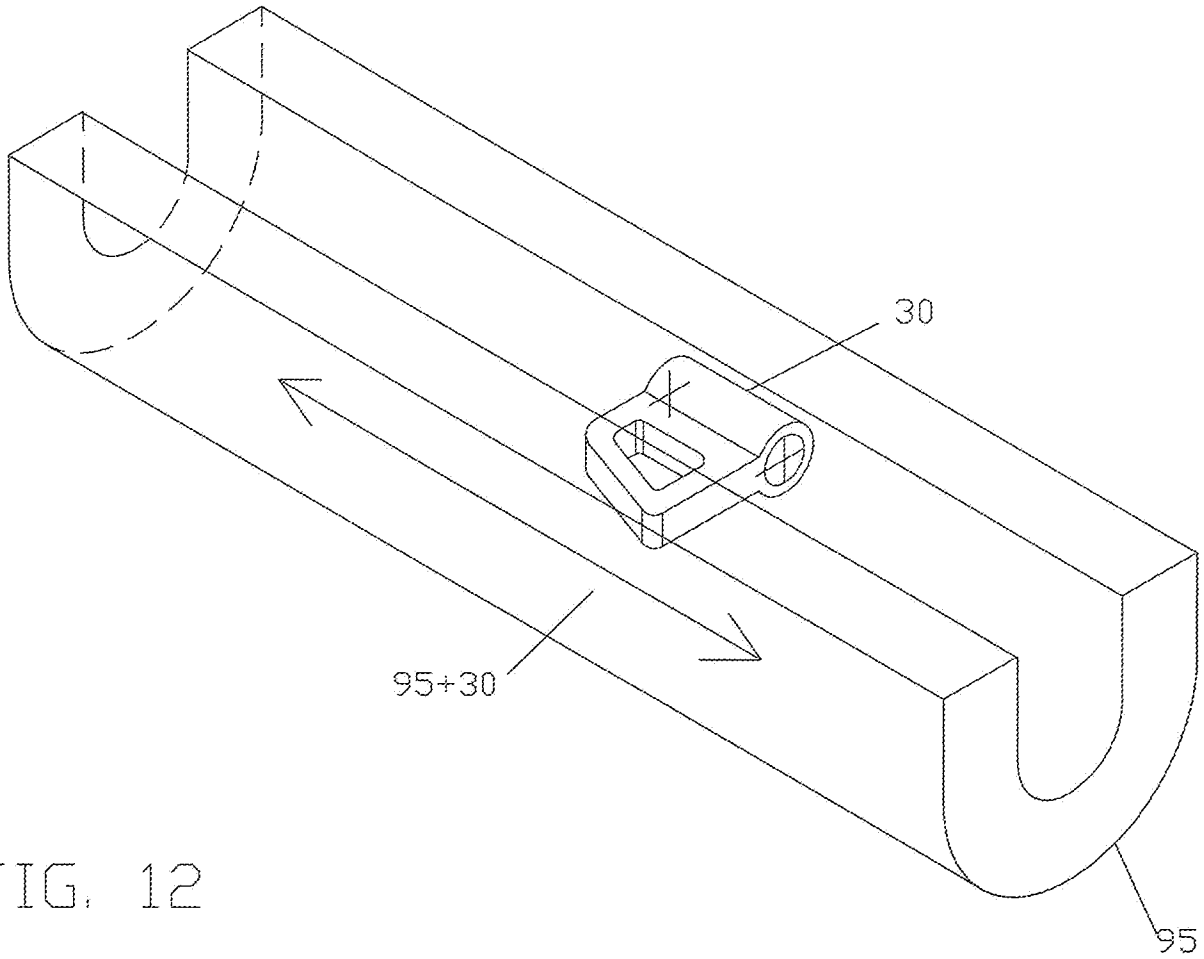
FIG. 12 is a schematic isomeric view of a sliding front guard handle (95) coupled with the lateral external charging handle portion (30 A) to enable the "Pump Action" charging action.
Figure 13:
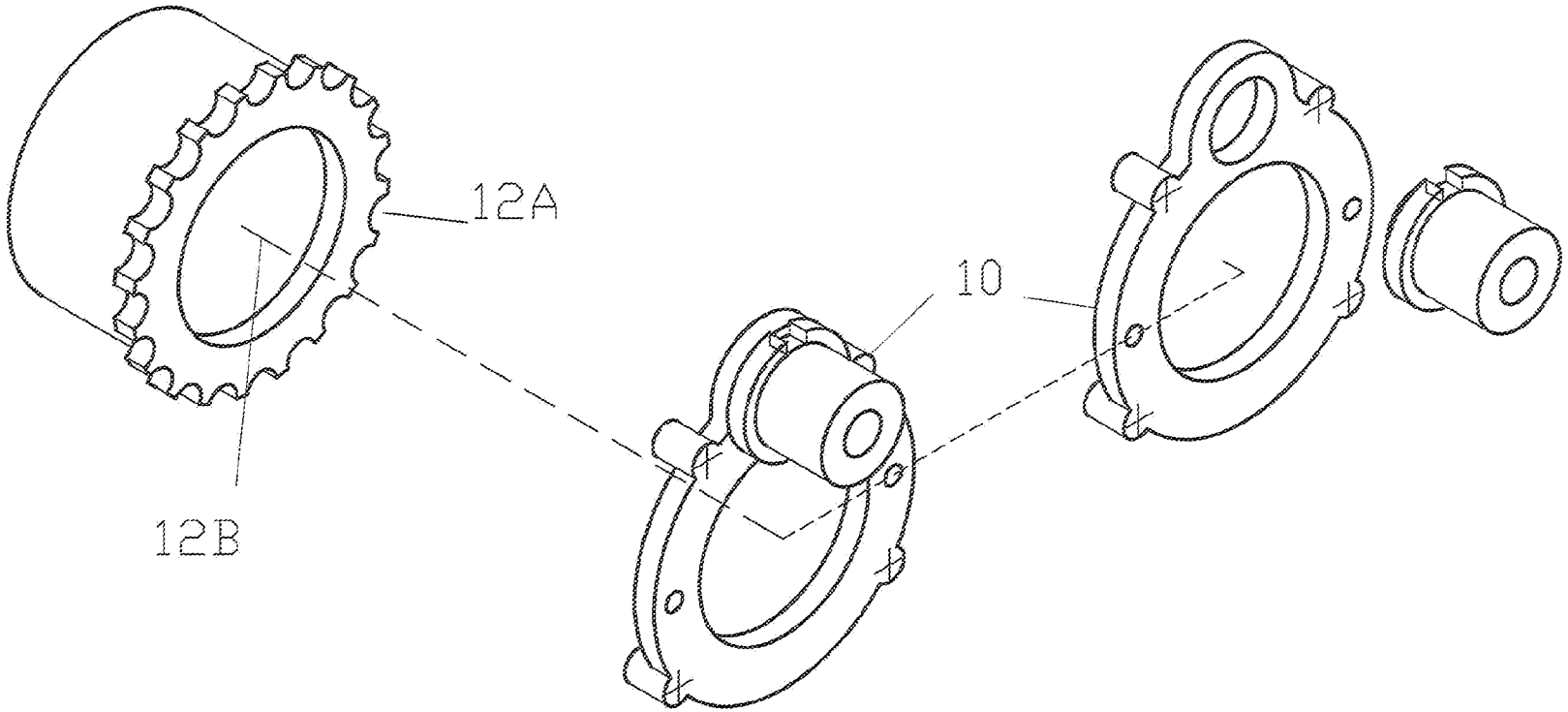

| PART NUMBER | NAME |
|---|---|
| 10 | TUBE SUPPORT ADAPTING PLATE |
| 10A | REAR PINS |
| 10B | BARREL HOLE |
| 10C | ROD BORE |
| 10D | HAND GUARD SUPPORT HOLE |
| 11 | TUBE SUPPORTING LUG |
| 11A | ANULAR INSERTION CUT |
| 11B | ROD BORE GUIDE |
| 12 | BARREL NUT |
| 12A | SEMI CIRCULAR CUT |
| 12B | HOLE FOR BARREL |
| 13 | BOLT CARRIER |
| 13A | BOLT CARRIER GAS KEY REPLACEMENT |
| 14 | BARREL |
| 14A | BARREL GAS PORT |
| 20 | FLOATING GAS CYLINDER ACTUATOR |
| 20A | LATERAL ALIGNEMENT GUIDE KEY |
| 20B | LATERAL EXHAUST PORT |
| 20C | INTERNAL CYLINDRICAL CAVITY |
| 20D | MAIN HIGH PRESURE EXPANSION CHAMBER |
| 20E | REAR CYLINDEICAL CAVITY |
| 20F | SLIM PORTION |
| 20G | FRONT ANNULAR FACE |
| 30 | FLOATING CHARGING HANDLE CYLINDER |
| 30A | LATERAL EXTERIOR CHARGING HANDLE |
| 30B | CENTER BORE |
| 30C | PIVOT HOLE |
| 30D | ARTICULATED HANDLE EXTENSION |
| 30E | PIVOTING PIN |
| 30F | REAR FACE |
| 40 | GAS PLUG PISTON REGULATOR |
| 40A | NARROW EXHAUST PORTION STUD |
| 40B | LOCKING SEMICIRCULAR CUT |

-continued

| PART NUMBER | NAME |
|---|---|
| 40C | EXTERNAL KNOB |
| 40D | LATERAL REGULAITNG RADIAL APERTURES ARRAY |
| 40E | GAS INJECTION PASSAGE |
| 40F | ANULAR ROTATIONAL LOCK HOLES ARRAY |
| 40G | LOCKING DIMPLE |
| 40H | GAS PLUG REAR FACE |
| 40I | EXHAUST PORT |
| 50 | UPPER GAS BLOCK |
| 50A | SECURING ROD BORE |
| 50B | UNDER CUT FOR TUBE SUPPORT |
| 50C | HIGH PRESSURE GAS APERTURE |
| 50D | GAS PLUG PISTON REGULATOR BORE |
| 50E | DOUBLE V DOVETAIL MALE |
| 50F | RETENTION SPRING BORE |
| 51 | SECURING ROD |
| 51A | RETAINING PIN |
| 51B | RETAINING SLOTS |
| 52 | RETENTION PIN |
| 60 | LOWER GAS BLOCK |
| 60A | BARREL BORE CLAMP |
| 60B | HIGH PRESSURE GAS APERTURE |
| 60C | DOUBLE V DOVETAIL FEMALE |
| 60D | SCREW HOLES |
| 60E | SCREW |
| 65 | ONE PIECE GAS BLOCK |
| 65A | BARREL BORE CLAMP |
| 65B | HIGH PRESSURE GAS APPERTURE |
| 65C | UNDERCUT FOR TUBE SUPPORT |
| 65D | SCREW HOLES |
| 65E | GAS PLUG PISTON REGULATOR BORE |
| 65F | SECURING ROD BORE |
| 65G | RETENTION SPRING BORE |
| 65H | UPPER FACE |
| 65I | SCREW |
| 65J | RETENTION SPRING |
| 65K | REAR FACE |
| 70 | STRUCTURAL SUPPORTING GUIDE TUBE |
| 70A | ENGAGING GROVES |
| 70B | FORE END |
| 70C | REAR RND |
| 70D | LOCKING PROTRUSIONS |
| 70E | INTERNAL WALL OF TUBE |
| 80 | PUSH ROD |
| 80A | FORE END |
| 80B | REAR END |
| 80C | CYLINDRICAL RING |
| 90 | COMPRESION SPRING |
| 95 | SLIDING FRONT HANDGUARD |

Purposes or Objectives

Several objectives or purposes are achieved in this invention, and the order in which they are presented is for the purpose of organization of this writing only, and certainly are not associated to its individual importance relative to the other objectives. All objectives are considered of equal importance in the achievement of the goal of mixing the objectives in a manner that all are satisfied practically.

This invention focuses in providing solutions to two of the flaws, deficiencies and limitations of previous M16 platform designs, through achieving several different purposes or objectives, all of them having equal importance, which sometimes compete one against each other, in a manner that demands sacrificing the prevalence of one objective over others in order to merge, in a sensible way, the accomplishment of all objectives. It is a careful trade of ergonomics, portability, fire power, fire comfort, ease of field service and manufacturing, preserving the compactness and conventional silhouette of the original design, and the ease of service and installation.

PURPOSES OR OBJECTIVES, DETAILED DESCRIPTION

To provide, in a single mechanism array, a direct drive gas piston system, working simultaneously in cooperation with a frontal ambidextrous, not reciprocating, charging system for m 16 and alike rifles, automatic or semiautomatic, capable of operating in tandem with the original rear t charging handle.

The mechanism array should be capable of being installed in existing rifles as a retrofit kit without requiring any machining or permanent modifications to the original receiver.

The gas block assembly composed of two ensemble able parts to facilitate the cleaning and installation procedure; an upper gas block and a lower gas block, which functions like a traditional one piece block when assembled together.

A single gas block can with the proper attributes will also perform properly.

The system having an external lateral ambidextrous charging handle to be operated when required by the frontal supporting hand for ease of operation.

The frontal charging handle capable of coupling with a horizontally sliding frontal hand guard to provide a pump action charging alternatively.

The system working inside a structural tube to provide rigidity and prevent harmonic vibrations.

The system having adapting supports to be coupled with existing parts and shapes of the receiver with the proper protrusions and cavities to provide a secure motion constraining fixation means to the rifle.

The system should provide an easy manner to disassembly in the field.

The system should be dismountable to return the rifle to the factory original condition.

The system should be compact enough to preserve the general shape of the rifle without adding significant weight to the rifle.

One single tube support adaptor plate, by design, must to be coupled with the Barrel nut of the M16 rifle is needed to provide the reat structural tube support. At the front, the gas block provides the complete support to the system. Nothing to machine.

Completely reversible retrofit.

Description of the Components, and how they do Interact.

The combination of several elements interacting together is what makes this invention remarkable. All previous direct drive gas piston systems to replace the gas impingement system have rods or bars which at some point operate in cantilever supported only by a portion penetrating inside the receiver without any other support which generates disturbing harmonic vibrations affecting the performance of the system and demanding thicker sections of the bar. This invention utilizes a structural supporting Guide Tube (70) to contain and constrain laterally the displacement of all mechanisms within. Especially important it is for the Push Rod (80) which has a Cylindrical Ring (80A) sliding internally with proper tolerance against the internal diameter surface of the supporting tube (70). Such contact is unique to this design since all others lack of any structural tube which provides alignment and support necessary to prevent the lateral harmonic vibration. By having a permanent lateral contact with the tube the push bar never is in cantilever support. It is important to this invention to provide a rigid Guide Tube (70) to grant support, containment and alignment to most of its components. A Tube Support Adapting Plate (10) of unique shape and design to couple with the receiver or parts attached to it is a non permanent means of securely affixing and constraining the Guide Tube (70) to the rifle at the rear, without interfering the action or altering its integrity. At the front, the Guide Tube (70) is affixed, and constrained to rotation or linear horizontal displacement, to the rear wall end of the Gas Block (65), which in turn is securely affixed to the barrel by means of the Barrel Bore Clamp (65B). A Floating Charging Handle Cylinder (30) array operates sliding inside said Tube Guide (70) in conjunction and complete independence of the parts involved in the direct drive action. A Main High Pressure Expansion Chamber (20D) of the Floating Gas Cylinder (20) has a "Sine qua non" (impossible to do without) requisite of necessary importance in attaining the required momentum to force the Bolt Carrier (13) rearwards to extract the used case and load a new round from the magazine. Without the Expansion Chamber (20D) the impacting force of the Direct Drive gas System may not be strong enough to force the displacement of the Bolt Carrier and Bolt inside the rifle receiver.

No permanent modification of the M-16 rifle o AR 15 platform rifles is needed to install this kit, condition which makes possible the reverse procedure of uninstalling the kit, leaving the rifle in an original state.

In this invention the gas block device can be constructed as a single unit piece, using part (65), or as a two piece gas block, so that when assembled together the Lower gas block (60), and the Upper Gas Bolt (50), both become a unit that, exactly matches the one piece gas block (65). The two piece gas block facilitates the complete disassembly procedure for cleaning of the gas system more thoroughly. The Upper Gas Bolt (60), slides completely wuzzlewards allowing the complete removal of the all the parts of the Direct drive gas piston system, and those of the lateral front charging system.

Description of how to Install the Retrofit Kit.

The following description for Assembly is made when utilizing the One Piece Gas Block (65)

To assemble, in one of the possible embodiments, proceed as follows: Remove front hand guards from the rifle. Remove the existing OEM gas block and front sight or from the rifle. Remove existing OEM gas impingement tube. Then from the muzzle end introduce the rifle barrel through the Annular Barrel Bore (10B) of a Tube Support Adapting Plate (10) with a Tube Supporting lug (11) facing foreword. Then press The Rear Pins (10A) of the Tube Support Adapting Plate (10) against a Semi Circular Cuts (12A) of a Barrel Nut (12). Then introduce the Locking Protrusions (70D) of a Guide Tube (70) inside an Annular Insertion Cut (11A) of said Tube Supporting lug (11) assuring that the Engaging Groves (70A) are placed to the side of preference where the Lateral Charging handle (30A) will be operating. Then, introduce a Compression Spring (90) inside said Guide Tube (70) from the Fore End (70B). Then, introduce the Rear End Push Rod (80B) through said Compression Spring (90), and continue introducing a Push Rod Push Rod (80) through the Rod Bore Guide (11B) of said Tube Supporting lug (11). Then Introduce the Rear Cylindrical Cavity (20E) of a Floating Gas Cylinder (20) through the Fore End (70B) assuring that a Lateral Alignment Guide (20A) slides through the Engaging Groves (70A) and that the Fore End Push Rod (80A) penetrates inside Rear a Cylindrical Cavity (20E). A Cylindrical Ring Push Rod (80C) should move freely through the Internal Wall of the supporting Tube (70E); Then, Introduce a Floating Charging Handle Cylinder (30) inside said Fore End (70B) assuring that Pivot Hole (30C) is placed towards the muzzle end, and that Center Bore (30B) slides into a Slim Portion (20F) of Floating Gas Cylinder (20). Then introduce the muzzle end of the barrel through a Barrel Bore Clamp (65A) of a One Piece Gas Block (65) assuring that Retention a Spring Bore (65G) faces towards the muzzle end. Slide said One Piece Gas Block (65) rearwards so that the Rear Face (65K) contacts the step on the Barrel (14), close to the Barrel Gas Port (14A), and aligns with a High Pressure gas Aperture (65B); also make sure that Fore End (70B) penetrates inside the Undercut for Tube Support (65C) of One Piece Gas Block (65). Place the Retention Spring (65J) inside said Retention Spring Bore (65G). Fore End of a Retention Spring (65J) will go inside a Locking Dimple (40G) to secure rotation of a Gas Plug Piston Regulator (40). Introduce said Gas Plug Piston Regulator (40) through a Gas Plug Piston Regulator Bore (65E) assuring that the External Knob (40C) penetrates inside Internal Cylindrical Cavity (20C) of a Floating Gas Cylinder actuator (20). Push said External Knob (40C) rearwards and insert a Securing Rod (51) through a Securing Rod Bore (65F) and place two Retaining Pins (51A) on a Retaining Slot (51B). Align Upper Face (65H) with the horizontal top of the rifle by rotating One Piece Gas Block (65) to assure alignment of Barrel (14) with High Pressure gas Aperture (65B). Insert Screw (65I) through Screw Holes (65D) and tighten.

The above description is based in the utilization of One Piece Gas Block (65)

Description of how the Invention Achieves the Result.

Two different systems operate jointly in cooperation without interfering in any instance of the independent operations.

The operation of the direct drive gas piston system is of pneumatic (gas) nature where dynamics of gases apply forcing mechanical dynamics to apply also.

In one of the possible embodiments of this invention the gas block device can be constructed as a single unit piece, using the one piece gas block part (65), In another possible embodiment a two piece gas block assembly is possible, in a manner that when assembled together, the upper gas block part number (50) and the lower gas block part number (60), both become a unit that exactly matches the one piece gas block (65). For disassembly, the lower gas block part number (60) remains attached to the barrel, and the upper gas block part number (50) slides muzzlewards facilitating the fast complete disassembly procedure for thoroughly cleaning all the components of the gas system, as well as the frontal cocking charging system.

The following description is based in the alternative utilization of a Two Piece Gas Block. Parts (50) and (60) assembled together.

Description of how the Invention Works with Respect to the Direct Gas Piston Operation In the direct drive Gas Piston operation, the non reciprocating Lateral Exterior Charging handle (30A) and the Floating Charging Cylinder (30) do not intervene at all. They are completely independent.

After igniting the powder of the cartridge, the projectile moves through the bore of a Barrel (14) in response to the high pressure propellant gases. Immediately after passing a Barrel Gas Port (14A), a portion of the high pressure gasses diverts out of the barrel through a High Pressure Gas Aperture (60B) of a Lower Gas Block (60), which aligns with a High Pressure Gas Aperture (50C) of a Upper Gas Block (50), which is aligned with a Lateral Regulating Radial Apertures Array (40D) of a Gas Plug Piston Regulator (40), which conveys the high pressure gases to the Gas Injection Passage (40E). The Exhaust Portion (40E) of the Gas Plug Piston Regulator (40) penetrates inside the Internal Cylindrical Cavity (20C) of the Floating Gas Cylinder (20), allowing the high pressure gasses to penetrate into the Main High Pressure Expansion Chamber (20D). The high pressure gasses act over the rear face of the Main High Pressure Expansion Chamber (20D) with a force described by the equation $F=P\times A$ where P is the high pressure of gasses inside Main High Pressure Expansion Chamber (20D) multiplied by the rear area (A) of the Main High Pressure Expansion Chamber (20D). This forces the Floating Gas Cylinder (20) to move rearwards impacting Fore End Push Rod (80A) of Push Rod (80) which is nested inside Rear Cylindrical Cavity (20E), causing the Rear End Push Rod (80B) to ram against the Bolt Carrier Key (13A) of the Bolt Carrier (13), which in turn displaces rearwards compressing the main spring inside the receiver ejecting the empty case, and in a reciprocating forward movement displaces a new live round from the magazine forcing it into the Barrel (14) chamber, thus completing the automatic firing loading cycle. The Compression Spring 90 forces the Push Rod (80) forward back into the Rear Cylindrical Cavity (20E), and Exhaust Portion (40A) completely coupled into Internal Cylindrical Cavity (20C). It must be understood that the Gas Plug Piston Regulator (40) is housed inside the gas plug piston regulator bore (50D) of the Gas Block (50) and remains immobile horizontally, but can be rotated to regulate the high pressure gasses flow. The Gas Plug Piston Regulator (40) has an array if several Lateral Regulating Radial Apertures Array (40D) of different diameters that align with High Pressure Gas Aperture (50C) and constrains and conduct the high pressure gasses flow into Gas Injection Passage (40E), and ultimately to the Main High Pressure Expansion Chamber (20D) where there is a rear wall of larger projected area over which the high pressure acts producing a strong force in the rearwards direction which is transmitted to the Push Bar (80) displaces rearwards together with the floating Gas Cylinder Actuator (20) When the Exhaust Port (20B) of Floating Gas Cylinder (20) aligns with Gas Plug Rear Face (40H) the high pressure gasses are relived and expelled to the exterior through an Exhaust Port (20B) passing through the Engaging Groves (70A) of the Guide Tube (70). The Lateral Alignment Guide (20A) slides by the Engaging Groves (70A) maintaining permanent alignment of the Exhaust Port (20B) with the Engaging Groves Engaging Groves (70A) and allowing the longitudinal displacement of Floating Gas Cylinder (20), while constraining any rotation, thus assuring the unrestricted flow of the gasses through the Engaging Groves (70A) to the exterior. The Floating Charging Handle Cylinder (30) remained immobile during the above described action resulting in a non reciprocation act due to the sufficient clearance of the internal wall of The Floating Charging Handle Cylinder (30), and the external wall of the slim portion (20F) of the Floating Gas Cylinder Actuator (20).

Description of how the Invention Works with Respect to the Charging Action

The operation of the Frontal lateral Ambidextrous, non reciprocating charging system is of mechanical nature only.

When the firer manually pulls an Articulated Handle Extension (30D) rearwards it acts over a rear face surface (30F) having an annular shape which contacts the Front Annular Face (20G) of the Floating Charging Handle Cylinder (30) producing a rearwards force and a displacement. A Center Bore (30B) of Floating Charging Handle Cylinder (30) slides loosely out of the Slim Portion (20F) of the Floating Gas Cylinder (20), and slides inside the Internal Wall of the Tube (70E), and the Lateral Charging handle (30A) displaces linearly only along the Engaging Groves (70A). The Floating Charging Handle Cylinder (30) is a part independent of the direct drive impingement action. It has a spring loaded Articulated Handle Extension (30D) that pivots about the Pivoting Pin (30E) to provide a larger cocking handle to ease the rearwards pulling of the firer for cocking. At that moment the Rear Face (30F) of Floating Charging Handle Cylinder (30) contacts and pushes the Annular Face (20G). This forces the Floating Gas Cylinder (20) to displace rearwards pushing Fore End Push Rod (80A) of Push Rod Push Rod Push Rod (80) which is nested inside Rear Cylindrical Cavity (20E), causing the Rear End Push Rod (80B) to move against the Bolt Carrier Key (13A) of the Bolt Carrier (13), which in turn displaces rearwards compressing the main spring inside the receiver ejecting the empty case. When releasing the Articulated Handle Extension (30D), the compressed main spring of the rifle forces the bolt carriage forward and in a reciprocating forward movement displaces a new live round from the magazine forcing it into the Barrel (14) chamber, thus completing the cocking action. The Compression Spring (90) assists in the return of the Rod Push Rod (80), Floating Gas Cylinder (20), and the Floating Charging Handle Cylinder (30) to the frontal position.

The Guide Tube (70) is necessary to provide internal alignment, anti rotation, protection from dirt, to all the components within. The Guide Tube (70) is locked in position constraining lateral, longitudinal or rotational movements by Rear End (70C) at the rear Guide Tube (70) that couple with a Annular Insertion Cut (11). A conveniently placed on a Tube Support Adapting Plate (10), and at the front the Guide Tube (70) is supported by insertion on a Undercut for Tube Support (50B).

The Annular Insertion Cut (11A) are placed at 180 degrees so that the Rear End (70C) can be engaged in a manner that the Engaging Groves (70A) is placed either to the right of the rifle or to the left, Thus assuring an ambidextrous operation according to the preference of the firer.

CONCLUSION, RAMIFICATIONS AND SCOPE

The M 16 rifle has proven to be an extraordinary rifle under many combat circumstances. This invention makes the M16 even better.

Accordingly, the reader will see that the invention described herein remedies the two most prominent remaining flaws of the M16 family of rifles in one single addition to new rifles or as a retrofit kit for existing rifles. The M 16 has evolved and undergone several revisions and upgrades which have brought it to be considered outstanding due to its reliability, accuracy and performance. Several attempts have been made by the governments and private rifle developers to present a substitute weapon to be adopted by the military, but none up to now is more advantageous than the presently produced M-16/M-4. In addition, the AR-15 family of rifles produced and sold as a civilian version of the M-16 also benefits from the present invention which is totally compatible with its design for factory installation in new rifles produced or for retrofit installation by individual owners. However the major benefits of this development are in the tactical improvement represented, in drastic time reduction of the charging operation, reduction of body movements, protection of the shooter location concealment, drastic reduction of time to get back on target, it favors the use of more powerful scopes, it conveys more fire power and accuracy. The weight addition is very small, the manufacturing cost is low, and the retrofit operation is very simple. This innovative device has the potential of extending the life of service of the M16 rifle in the military or to be used for the next generation of rifles to be put in service in the future.

The incorporation to the design of an horizontally sliding intermediate cylinder collar with a external handle, operating in the outer portion of the cylinder actuator, between the piston and the actuator cylinder, being floating and independent, to the gas piston cylinder operation, enables the independent manual mechanical rear displacement to the rear of the Floating gas cylinder actuator, transmitting the motion to the push bar and ultimately displacing the bolt carrier rearward for manual charging operation, which in all previous art design moves pneumatically by the action of the expelled gasses only.

What I claim is:

1. A rifle having a forward charging system, the charging system comprising:

a circular tube support adapting plate having a front face and a rear face, the adapting plate having a plurality of pins extending from the rear face of the adapting plate, the pins interacting with semi-circular cuts along the perimeter of a barrel nut;

the adapter plate further having a removable tube supported lug extending from the front face of the adapting plate, the tube supported lug having an insertion slot along a portion of the perimeter of the lug;

a guide tube having a locking protrusion on the rear of the guide tube, the locking protrusion being inserted into the insertion slot of the tube supported lug, the guide tube further comprising a compression spring located inside the guide tube and a rear end push rod extending through the compression spring and through an opening in the tube supported lug;

a floating gas cylinder having a rear end placed through the front end of the guide tube, the floating gas cylinder having an laterally extending alignment pin engaging a groove in the guide tube, the guide tube further comprising a movable cylindrical ring push rod configured to move freely back and forth along the outer surface of the rear end push rod and through the interior of the guide tube;

the charging system further comprising a floating charging handle located along a front portion of the rifle between the floating gas cylinder and the muzzle of the rifle, the charging handle extending laterally from the rifle and in contact with an annular face of the floating gas cylinder, the charging handle having a bore wherein a portion of the floating gas cylinder extends through the bore of the charging handle, the charging handle having a front face and a rear face and an angled portion extending between the front and rear faces of the charging handle, the angled portion further comprising a pivot hole extending through the left and right side faces of the charging handle, the charging handle further comprising a lever connected to the charging handle via a pivot pin in the pivot hole, wherein the charging handle is operable to recharge the rifle by pulling rearward on the lever.

* * * * *